US009584898B2

(12) United States Patent
Bruins et al.

(10) Patent No.: US 9,584,898 B2
(45) Date of Patent: Feb. 28, 2017

(54) JOINER FOR A RECEIVER ASSEMBLY

(71) Applicant: Sonion Nederland B.V., Hoofddorp (NL)

(72) Inventors: Wouter Bruins, Utrecht (NL); Aart Zeger van Halteren, Hobrede (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 14/621,425

(22) Filed: Feb. 13, 2015

(65) Prior Publication Data

US 2015/0264468 A1 Sep. 17, 2015

(30) Foreign Application Priority Data

Feb. 14, 2014 (EP) ..... 14155152

(51) Int. Cl.
*H04R 1/10* (2006.01)
*H04R 1/26* (2006.01)
*H04R 25/00* (2006.01)

(52) U.S. Cl.
CPC ..... *H04R 1/1058* (2013.01); *H04R 1/26* (2013.01); *H04R 25/608* (2013.01); *H04R 1/1016* (2013.01)

(58) Field of Classification Search
CPC ..... H04R 1/1016; H04R 1/24; H04R 1/1058; H04R 1/26; H04R 25/608
USPC ..... 381/74, 370–372, 374, 376, 380–381
See application file for complete search history.

(56) References Cited

U.S. PATENT DOCUMENTS

| | | | |
|---|---|---|---|
| 5,887,070 | A | 3/1999 | Iseberg et al. |
| 6,788,796 | B1 | 9/2004 | Miles et al. |
| 6,831,577 | B1 | 12/2004 | Furst |
| 6,853,290 | B2 | 2/2005 | Jorgensen et al. |
| 6,859,542 | B2 | 2/2005 | Johannsen et al. |
| 6,888,408 | B2 | 5/2005 | Furst et al. |
| 6,914,992 | B1 | 7/2005 | van Halteren et al. |
| 6,919,519 | B2 | 7/2005 | Ravnkilde et al. |
| 6,930,259 | B1 | 8/2005 | Jorgensen et al. |

(Continued)

FOREIGN PATENT DOCUMENTS

| | | |
|---|---|---|
| CA | 2858644 | 6/2013 |
| WO | WO 2010/040351 A1 | 4/2010 |

(Continued)

OTHER PUBLICATIONS

Extended European Search Report corresponding to co-pending European Patent Application Serial No. EP15154470.7, dated May 29, 2015; (3 pages).

(Continued)

*Primary Examiner* — Disler Paul
(74) *Attorney, Agent, or Firm* — Nixon Peabody LLP

(57) ABSTRACT

A multiple receiver assembly comprising at least a first spout-less receiver comprising a sound output opening; and a joiner. The joiner comprises a mounting plate portion having a first surface and an opposite second surface, the mounting plate further defining a mounting plane; first engagement means for engaging the first spout-less receiver at the first surface; and a spout portion comprising at least one sound channel extending through the spout portion. The sound output opening is aligned with one of the at least one sound channels when the spout-less receiver engages the first engagement means.

19 Claims, 2 Drawing Sheets

(56) References Cited

U.S. PATENT DOCUMENTS 6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doorn et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Heltren et al.
7,239,714 B2 7/2007 de Blok et al.
7,245,734 B2 7/2007 Niederdraenk
7,254,248 B2 8/2007 Johannsen et al.
7,263,195 B2 * 8/2007 Harvey ..... H04R 1/1016 381/328
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bondo et al.
8,315,422 B2 11/2012 van Halteren et al.
8,331,595 B2 12/2012 van Halteren
8,369,552 B2 2/2013 Engbert et al.
8,379,899 B2 2/2013 van Halteren
8,509,468 B2 8/2013 van Halteren et al.
8,526,651 B2 9/2013 Lafort et al.
8,526,652 B2 9/2013 Ambrose et al.
8,548,181 B2 * 10/2013 Kraemer ..... H04R 1/1016 381/150
2002/0114483 A1 * 8/2002 Azima ..... H04R 1/24 381/345
2005/0053247 A1 * 3/2005 Petronio ..... H04R 3/14 381/99
2006/0098836 A1 * 5/2006 Sabick ..... H04R 1/1016 381/380
2006/0133636 A1 * 6/2006 Harvey ..... H04R 1/1016 381/380
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0008817 A1 1/2012 Grinker et al.
2012/0014548 A1 1/2012 van Halteren
2012/0027245 A1 2/2012 van Halteren et al.
2012/0140966 A1 6/2012 Mocking et al.
2012/0140975 A1 6/2012 Chang et al.
2012/0155683 A1 6/2012 van Halteren
2012/0155694 A1 6/2012 Reeuwijk et al.
2012/0255805 A1 10/2012 van Halteren et al.
2013/0004011 A1 * 1/2013 Hayashida ..... H04R 1/1016 381/380
2013/0028451 A1 1/2013 de Roo
2013/0136284 A1 5/2013 van Hal et al.
2013/0142370 A1 6/2013 Engbert et al.
2013/0163799 A1 6/2013 van Halteren
2013/0195295 A1 8/2013 van Halteren et al.

FOREIGN PATENT DOCUMENTS

WO WO 2010/040351 A8 4/2010
WO WO 2012/103935 A1 8/2012
WO WO 2013/004623 A1 1/2013
WO WO 2013/176840 A1 11/2013

OTHER PUBLICATIONS

European Search Report corresponding to co-pending European Patent Application Serial No. EP1455152.3, dated Jun. 20, 2015; (3 pages).

* cited by examiner

JOINER FOR A RECEIVER ASSEMBLY

CROSS-REFERENCE TO RELATED APPLICATION

This application claims the benefit of European Patent Application Serial No. EP14155152.3, filed Feb. 14, 2014, and titled "A Joiner For A Receiver Assembly," which is incorporated herein by reference in its entirety.

FIELD OF THE INVENTION

The present invention relates to a receiver assembly for in-ear-monitors, earphones, headphones, or other in-ear applications. In particular, the present invention relates to a joiner for mounting two or more receivers jointly together.

BACKGROUND OF THE INVENTION

For In-Ear-Monitors and other Pro-Audio applications different miniature receivers, such as a woofer and a tweeter, are combined to obtain a full audio frequency spectrum. In order to handle such receivers in a convenient manner, a single assembly of receivers is constructed. Such an assembly has a fixture that mechanically connects two or more receivers, and a PCB providing electrical connections to the respective receivers. In some applications the assembly is further provided with a manifold for acoustic filtering. An example is shown in international application WO 2013/176840.

Such a receiver has a number of limitations, for example: Balanced armatures are preferred because of form-factor and efficiency, but when joining Balanced armatures in dual or multiple setup this advantage is lost. Fixtures are made of metal to allow the receivers housings to be welded to the fixture, which requires a rather thick plate. During assembly, positioning and alignment of the receivers and fixture is a cumbersome process and requires additional registering fixtures. Therefore there is a need for a simple device that alleviates the aforementioned drawbacks.

DESCRIPTION OF THE INVENTION

It is an object of embodiment of the invention to provide an improved joiner for a receiver assembly.

According to a first aspect, the invention provides a multiple receiver assembly comprising at least a first spout-less receiver comprising a sound output opening; and a joiner comprising a mounting plate portion having a first surface and an opposite second surface, the mounting plate further defining a mounting plane; first engagement means for engaging the first spout-less receiver at the first surface; and a spout portion comprising at least one sound channel extending through the spout portion; wherein the sound output opening is aligned with one of the at least one sound channels when the spout-less receiver engages the first engagement means.

It should be understood, that the mounting plane extends in the same plane as the mounting plate.

By "aligned" is herein meant, that a sound channel is at least partly overlapping a sound output opening when viewed in parallel with the mounting plane, whereby sound and air can be transmitted from the sound output opening to the sound channel. As the cross-sectional area of the sound output opening and the sound channel may be different, these may only be partly overlapping. In case, the size and shape of the sound channel and the sound output opening are identical, they can be arranged so that the fully overlap.

It should further be understood, that the sound channel and the sound output opening are arranged at an angle relative to each other, i.e. at least one of them may be arranged transverse to the mounting plane.

In the context of the present invention, the term 'spout-less receiver' should be understood as, a receiver which does not comprise a spout extending on the outside of the housing of the receiver. Sound may be transmitted from the receiver via an opening in one surface of the housing.

In other words, the spout-less receiver may have an outer surface being symmetrically about a plane through the receiver housing, except for the opening provided for sound output from the receiver.

The assembly may comprise a second spout-less receiver, and the joiner may further comprise second engagement means for engaging the second spout-less receiver at the second surface, whereby a sound output opening of the second spout-less receiver can be aligned with one of the at least one sound channels when the second spout-less receiver engages the second engagement means.

The sound output openings of the first and second spout-less receivers may in one embodiment be aligned with the same sound channel. Alternatively, the first and second spout-less receivers may each be aligned with a sound channel. In the later case, the spout portion and the mounting plate portion may be arranged such that a sound channel is located on each side of the mounting plane.

The first engagement means may facilitate positioning of the first receiver during assembly of the receiver assembly. As an adhesive may be located at the engagement means and/or at the mounting plate, the receiver(s) may be adhesively attached to the joiner after being positioned correctly by use of the engagement means.

In one embodiment, the engagement means are provided as raised clamping edges at the first and/or second surface for clamping a receiver. Thus, the receiver(s) may be fastened to the mounting plate portion by frictional forces between a pair of clamping edges. The clamping edges may be located on each side of the mounting plate so that each edge extends in a plane being perpendicular to the mounting plane.

As an alternative or in addition to the clamping edges, the engagement means may be provided as grooves, tracks, bumps, spikes, protrusions and/or dents or the like. The joiner may be made in one piece as a single solid piece by injection molding, stereolithography, 3D-printing, or other plastic manufacturing process.

At least one sound channel may comprise an acoustic filter. In embodiments having two sound channels, an acoustic filter may be arranged in each of the sound channels. The acoustic filters may be identical or may be different.

The first and second engagement means may be arranged on both sides of the mounting plane, each engagement means engaging respective receivers. Alternatively, the first and second engagement means may be the same so that two receivers may engage the joiner by use of common engagement means, one receiver engaging on each side of the mounting plane. Thus, the engagement means may be arranged so that it extends on both sides of the mounting plane. The receivers may be identical or at least having the same outer dimensions. However, the engagement means may also be arranged for accommodating receivers of different size.

To simplify the multiple receiver assembly, the mounting plate portion may further comprise electrical connector parts for providing contact between the first receiver and a connector part of a signal- and/or power cable. As an example, the electrical connector parts may be arranged so that they extend perpendicular from the mounting plate at the opposite end relative to the location of the spout portion. As an alternative, the electrical connector parts may be arranged on the engagement means. Other positions may also be used. Similar or identical connector parts may also be provided for contact between the second receiver and a connector part.

The electrical connector parts may comprise electrical conducting tracks for cooperation with slide contacts of the first receiver. This may likewise be the case for the second receiver.

The joiner may further comprise an electronic circuit at least partially located within the mounting plate portion.

To facilitate dampening of vibrations, e.g. due to the mounting of two receivers of different size and/or weight, the joiner may further comprise vibration reduction means arranged for resilient mounting of the first receiver. Similar vibration reduction means may be arranged for resilient mounting of the second receiver.

In one embodiment, the vibration reduction means comprises a resilient strip positioned on the mounting plate alongside at least one of the first and second engagement means. The resilient strip may have a length corresponding to the length of the engagement means. It should however be understood, that the length may also be smaller, so that the resilient strip is positioned only along a part of the engagement means.

The vibration reduction means may be made from a gel, a foam, a resilient plastic material, such as a rubber band, or another suitable material possessing compliant material characteristics.

To increase the dampening of the vibrations, the vibration reduction means may be provided on both the first and second surface of the mounting plate. The vibration reduction means may each be optimized for reducing a different resonance frequency. This may as an example be done by providing the vibration reduction means of different materials and/or of different size.

According to a second aspect, the invention provides a joiner for use in a multiple receiver assembly according to the first aspect of the invention, the joiner comprising:

- a mounting plate portion having a first surface and an opposite second surface, the mounting plate further defining a mounting plane;
- first engagement means configured for engagement of a first spout-less receiver at the first surface; and
- a spout portion comprising at least one sound channel extending through the spout portion;

wherein one of the at least one sound channels is configured to be aligned with a sound output opening of the first spout-less receiver, when the first spout-less receiver engages the first engagement means.

It should be understood, that a skilled person would readily recognise that any feature described in combination with the first aspect of the invention could also be combined with the second aspect of the invention. The remarks set forth above in relation to the first aspect are therefore equally applicable in relation to joiner according to the second aspect.

In one embodiment, the invention relates to a joiner for assembling a multiple receiver assembly having a mounting plate portion having a first surface and a second opposite surface, the mounting plate further defining a mounting plane. And further having a spout portion comprising two sound channels running through the spout. The spout portion and the mounting plate portion are arranged such that the two sound channels are located on respective sides of the mounting plane. The use of such a joiner allows a less cumbersome assembly of a receiver assembly. The joiner may further have alignment means, such as ridges, edges, grooves or the like. In the case of edges these can be arranged to provide a clamping force for clamping a receiver. One or both of the sound channels of the spout may be provided with an acoustic filter such as an acoustic mass e.g. embodied in a tube or lumen.

It should be understood, that a skilled person would readily recognise that any feature described in combination with the first and second aspects of the invention could also be combined with the above mentioned embodiment. The remarks set forth above in relation to the first and second aspects are therefore equally applicable in relation to this embodiment.

In a preferred embodiment, the spout is made as an integral part from plastic. For example manufactured by injection molding, Stereo lithography (SLA), 3D-printing or other manufacturing process providing a solid plastic part. The use of these techniques and especially plastic allows more freedom for design to accommodate receivers of different size on each side of the joiner. Moreover, one side of the joiner may be designed such that it can accommodate receivers of different size at the same side.

A further advantage of the plastic joiner is that it allows gluing. And such gluing allows dispensing with the cover of the one or more receivers. As the edge of the case is too small to carry glue—it will run of inside the case and harm the motor assembly of a balanced armature receiver—the glue would have to be placed on the fixture introducing further alignment difficulties. However, the flexibility and precision in design and manufacture made possible by use of plastic is unachievable with steel and/or metal, and allows accurate placement of the alignment means and hence application of glue at the correct location.

In another embodiment, the invention relates to a joiner with vibration reduction means arranged for resilient mounting of a receiver. For hearing aids, the use of so-called dual receivers was introduced to reduce vibration by having two receivers identical in mass and size move in counter phase, thereby reducing the overall vibration originating from the dual receiver assembly. However, in pro-audio applications a Tweeter and Woofer combination is preferred which differ in size and mass. To alleviate the vibration stemming from such a combination, the mounting plate of the joiner is provided with vibration reduction means such as gel or a resilient ring like band positioned on or alongside the alignment means. In one embodiment, the vibration reduction means are provided on both the first and second surface of the mounting plate and are each optimized for reducing a different resonance frequency corresponding to the a resonance frequency of receiver mounted on that side.

It should be understood, that a skilled person would readily recognise that any feature described in combination with the first and second aspects of the invention could also be combined with the above mentioned embodiment. The remarks set forth above in relation to the first and second aspects are therefore equally applicable in relation to this embodiment.

BRIEF DESCRIPTION OF THE DRAWINGS

Embodiments of the invention will now be further described with reference to the drawings, in which.

DETAILED DESCRIPTION OF THE DRAWINGS

Figure 1:
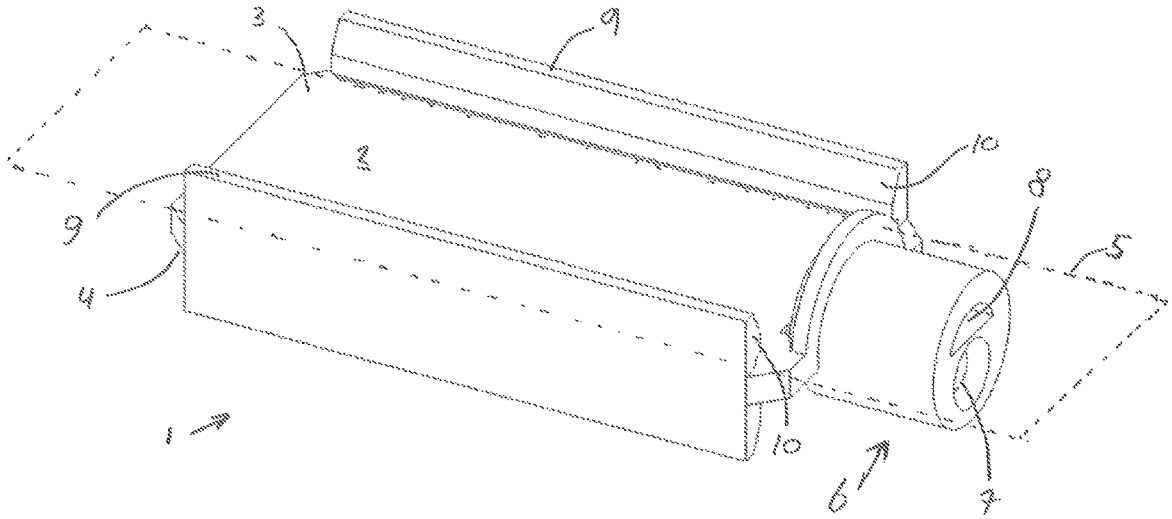
FIG. 1 shows a perspective view of a joiner according to the invention.

FIG. 1 shows a joiner 1 for assembling a multiple receiver assembly having a mounting plate portion 2. The mounting plate has a first surface 3 and a second opposite surface 4 and defines a mounting plane 5. The joiner further has a spout portion 6 having two sound channels 7, 8 running through the spout portion 6. The spout portion 6 and the mounting plate portion 2 are arranged such that the two sound channels 7, 8 are located on respective opposite sides of the mounting plane 5. The mounting plate portion 2 further has alignment means 9 for registering a receiver during assembly on the mounting plate 2. In the embodiment, the alignment means 9 are provided as raised clamping edges 10 at both the first and the second surfaces 3, 4 for clamping a receiver. In another embodiment, the alignment means 9 can be provided on either the first surface 3 or the second surface 4. The alignment means 9 can be different for each surface, i.e. clamping edges on one side and a raised ridge on the other side. In yet other embodiments the alignment means can be provided as grooves, tracks, bumps, spikes, protrusions and/or dents or the like. In addition, the alignment means at one side may be arranged such that these can accommodate receivers of different size.

In a preferred embodiment, the joiner is made as a single solid piece. The manufacturing process can be injection molding, stereolithography (SLA) techniques, 3D-printing or another plastic manufacturing process.

Figure 2:
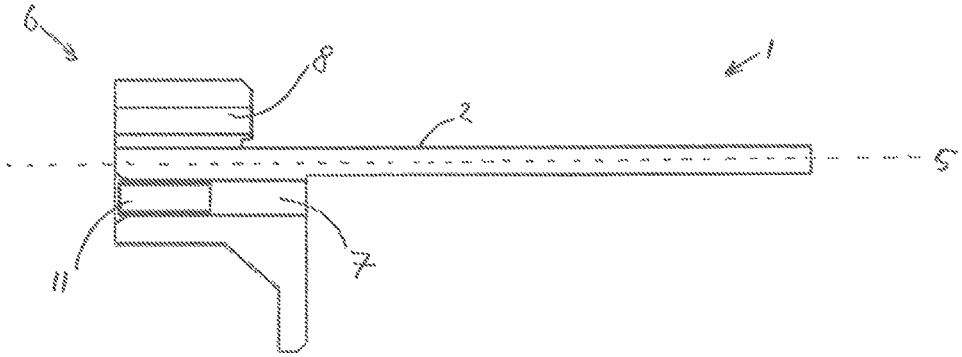
FIG. 2 shows a cross-section of the joiner of FIG. 1.

Turning to FIG. 2, the cross-section of the joiner 1 shows the sound channels 7, 8 running on respective sides of the mounting plane 5 as defined by the mounting plate portion 2. The sound channel 7 in the spout portion of 6 the joiner 1 has an acoustic filter 11. The use of the acoustic filter allows tuning the sound output corresponding to the frequency range produced by a receiver to be mounted.

Figure 3:
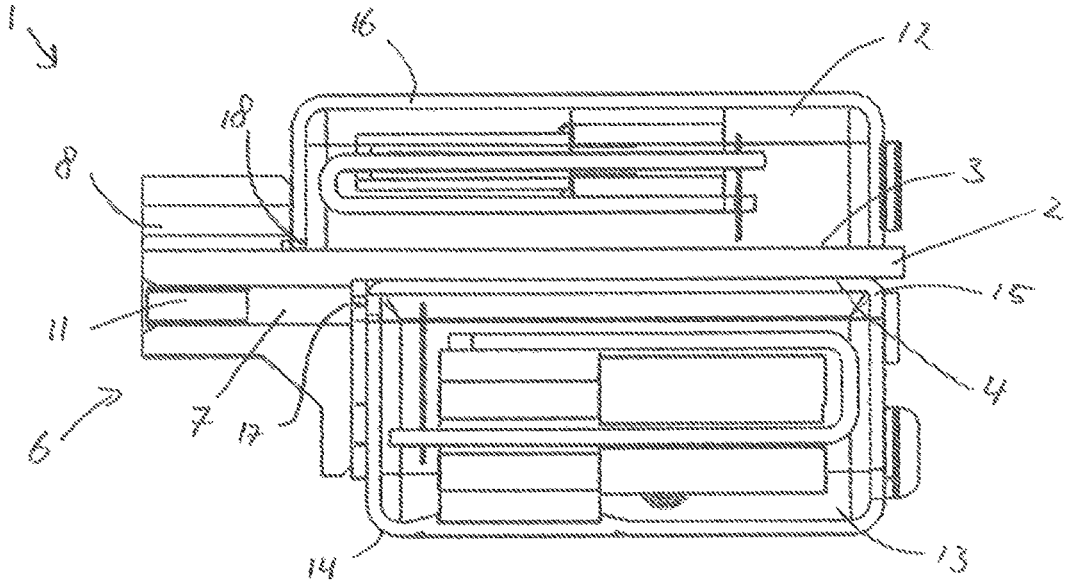
FIG. 3 shows a cross-section of a joiner having two receivers mounted.

FIG. 3 shows the joiner 1 having two receivers 12, 13 jointly mounted thereon thereby forming a receiver assembly. The first receiver 12 is mounted on the first surface 3 of the mounting plate portion 2. The second receiver 13 is mounted on the second surface 4 of the mounting plate portion 2. The second receiver 13 has a regular case 14 and cover 15 as commonly applied for e.g. balanced armature receivers. The first receiver 12 however has no cover but only a case 16. This is facilitated by the joiner that acoustically seals off the receiver alleviating the need for a cover. The second receiver 13 has a sound output 17 that is acoustically connected to sound channel 7 of the spout portion 6. The first receiver 12 has a sound opening 18 that is acoustically connected to the sound channel 8. When the second receiver 13 is a woofer, the acoustic filter 11 in the sound channel 7 is provided as a small tube that functions as a low pass filter. The first receiver 12 is a tweeter for reproducing the upper frequency spectrum of the sound signal delivered to the receiver assembly.

In one embodiment, the mounting plate portion 2 has electrical connector parts for providing contact between the first and/or second mounted receiver and the connector part of a signal- and/or power cable (not shown). The incorporation of electrical connective parts allows a more compact construction of the receiver assembly. The electrical connector parts can e.g. be provided as electrical conducting tracks for electrical and mechanical cooperation with slide contacts of a mounted receiver. The joiner can further be equipped with an electronic circuit located in the mounting plate portion 2. The electronic circuit may be at least partially located within the mounting plate portion or completely buried within the mounting plate 2.

Figure 4:
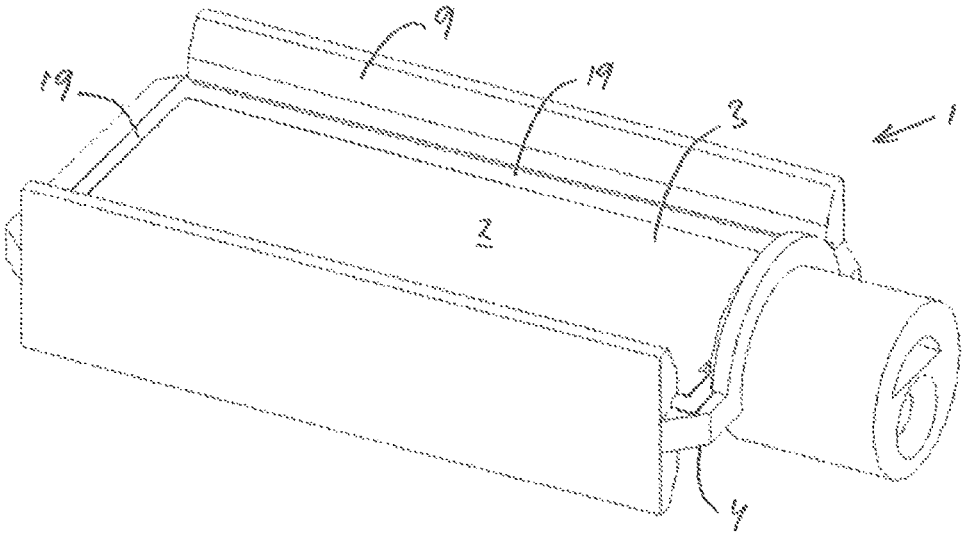
FIG. 4 shows a perspective view of a joiner according to a second aspect of the invention.

In another embodiment, shown in FIG. 4, the joiner 1 has vibration reduction means 19 arranged for resilient mounting of a receiver. These vibration reduction means comprise a resilient ring like strip 19 positioned on the mounting plate 2 alongside the alignment means 9. In other embodiments the vibration reduction means may be provided as a gel applied at the first 3 and/or second surface 4 of the mounting plate portion 2 or as a rubber band stretch around the circumference of the receiver assembly. When the vibration reduction means 19 are provided on both the first 3 and second surface 4 of the mounting plate portion 2 these can each be optimized for reducing a different resonance frequency. The resonance frequency being different for the first receiver 12 and the second receiver 13 as is the case for a woofer/tweeter receiver assembly.

While the present disclosure has been described with reference to one or more particular embodiments and implementations, those skilled in the art will recognize that many changes may be made thereto without departing from the spirit and scope of the present disclosure. Each of these embodiments and implementations and obvious variations thereof is contemplated as falling within the spirit and scope of the present invention, which is set forth in the claims that follow.

EMBODIMENTS

The invention may e.g. be covered by the following embodiments:

Embodiment 1

A joiner for assembling a multiple receiver assembly comprising a mounting plate portion having a first surface and a second opposite surface, the mounting plate further defining a mounting plane; and a spout portion comprising two sound channels running through the spout portion;

wherein the spout portion and the mounting plate portion are arranged such that the two sound channels are located on respective sides of the mounting plane.

Embodiment 2

A joiner according to embodiment 1, wherein the mounting plate portion further comprises alignment means for registering a receiver during assembly on the mounting plate.

Embodiment 3

A joiner according to embodiment 2, wherein the alignment means are provided as raised clamping edges at the first and/or second surface for clamping a receiver.

Embodiment 4

A joiner according to any of the preceding embodiments, wherein the joiner is made as a single solid piece by injection molding, stereolithography, 3D-printing or other plastic manufacturing process.

Embodiment 5

A joiner according to any of the preceding embodiments, wherein at least one sound channel comprises an acoustic filter.

Embodiment 6

A joiner according to any of the preceding embodiment, wherein the alignment means are arranged for accommodating receivers of different size.

Embodiment 7

A joiner according to any of the preceding embodiments, wherein the mounting plate portion further comprises electrical connector parts for providing contact between a mounted receiver and the connector part of a signal- and/or power cable.

Embodiment 8

A joiner according to any of the preceding embodiments, wherein the electrical connector parts comprise electrical conducting tracks for cooperation with slide contacts of a mounted receiver.

Embodiment 9

A joiner according to any of the preceding embodiments, the joiner further comprising an electronic circuit at least partially located within the mounting plate portion.

Embodiment 10

A joiner according to any of the preceding embodiments, the joiner further comprising vibration reduction means arranged for resilient mounting of a receiver.

Embodiment 11

A joiner according to embodiment 10, wherein the vibration reduction means comprise a resilient strip positioned on the mounting plate alongside the alignment means.

Embodiment 12

A joiner according to embodiment 10 or 11, wherein the vibration reduction means are provided on both the first and second surface of the mounting plate and are each optimized for reducing a different resonance frequency.

Embodiment 13

A receiver assembly comprising a joiner according any of the preceding embodiments.

Embodiment 14

A receiver assembly according to embodiment 13, comprising a rubber band stretched over the circumference of the receiver assembly.

The invention claimed is:

1. A multiple receiver assembly comprising at least a first spout-less receiver comprising a sound output opening; and a joiner comprising a mounting plate portion having a first surface and an opposite second surface, the mounting plate further defining a mounting plane;

first engagement means for engaging the first spout-less receiver at the first surface;

second engagement means for engaging a second spout-less receiver at the second surface; and a spout portion comprising at least one sound channel extending through the spout portion;

wherein the sound output opening is aligned with one of the at least one sound channels when the spout-less receiver engages the first engagement means, and wherein a sound output opening of the second spout-less receiver is aligned with one of the at least one sound channels when the second spout-less receiver engages the second engagement means.

2. An assembly according to claim 1, wherein the sound output openings of the first and second spout-less receivers are aligned with the same sound channel.

3. An assembly according to claim 1, wherein the first engagement means are provided as raised clamping edges at the first and/or second surface for clamping a receiver.

4. An assembly according to claim 1, wherein the joiner is made as a single solid piece by injection molding, stereolithography, 3D-printing or other plastic manufacturing process.

5. An assembly according to claim 1, wherein at least one sound channel comprises an acoustic filter.

6. An assembly according to any of claim 1, wherein the first and second engagement means are arranged for accommodating receivers of different size.

7. An assembly according to claim 1, wherein the mounting plate portion further comprises electrical connector parts for providing contact between the first receiver and a connector part of a signal cable or a power cable or at least a signal cable and a power cable.

8. An assembly according to claim 7, wherein the electrical connector parts comprise electrical conducting tracks for cooperation with slide contacts of the first receiver.

9. An assembly according to claim 1, the joiner further comprising an electronic circuit at least partially located within the mounting plate portion.

10. An assembly according to claim 1, the joiner further comprising vibration reduction means arranged for resilient mounting of the first receiver.

11. An assembly according to claim 10, wherein the vibration reduction means comprises a resilient strip positioned on the mounting plate alongside the first engagement means.

12. An assembly according to claim 10, wherein the vibration reduction means are provided on both the first and second surface of the mounting plate and are each optimized for reducing a different resonance frequency.

13. An assembly according to claim 1, comprising a rubber band stretched over a circumference of the receiver assembly.

14. A joiner for use in a multiple receiver assembly, the joiner comprising:

a mounting plate portion having a first surface and an opposite second surface, the mounting plate further defining a mounting plane;

first engagement means configured for engagement of a first spout-less receiver at the first surface;

second engagement means for engaging a second spout-less receiver at the second surface; and a spout portion comprising at least one sound channel extending through the spout portion;

wherein one of the at least one sound channels is configured to be aligned with a sound output opening of the first spout-less receiver, when the first spout-less receiver engages the first engagement means, and wherein a sound output opening of the second spout-less receiver is aligned with one of the at least one sound channels when the second spout-less receiver engages the second engagement means.

15. The joiner according to claim 14, wherein the sound output openings of the first and second spout-less receivers are aligned with the same sound channel.

16. The joiner according to claim 14, wherein the mounting plate portion further comprises electrical connector parts for providing contact between the first receiver and a connector part of a signal cable or a power cable or at least a signal cable and a power cable.

17. The joiner according to claim 14, the joiner further comprising (a) an electronic circuit at least partially located within the mounting plate portion or (b) vibration reduction means arranged for resilient mounting of the first receiver.

18. The joiner according to claim 17, wherein the vibration reduction means comprises a resilient strip positioned on the mounting plate alongside the first engagement means.

19. The joiner according to claim 17, wherein the vibration reduction means are provided on both the first and second surface of the mounting plate and are each optimized for reducing a different resonance frequency.

* * * * *